United States Patent [19]

Carrington

[11] Patent Number: 4,508,341

[45] Date of Patent: Apr. 2, 1985

[54] PASS-BLOCKING SLED

[76] Inventor: Michael R. Carrington, 2943 S. Parnell, Chicago, Ill. 60616

[21] Appl. No.: 425,633

[22] Filed: Sep. 28, 1982

[51] Int. Cl.[3] ..... A63B 67/00

[52] U.S. Cl. ..... 273/55 R; 272/141

[58] Field of Search ..... 273/55 R, 55 A; 272/116, 130, 132, 135, 136, 137, 77, 141, 901

[56] References Cited

U.S. PATENT DOCUMENTS

| | | | |
|---|---|---|---|
| 1,828,892 | 10/1931 | Felton | 273/55 R |
| 1,995,495 | 3/1935 | Barnick | 272/77 |
| 2,197,545 | 4/1940 | Bachman et al. | 272/77 |
| 3,563,542 | 2/1971 | Wellman | 272/135 |
| 3,822,599 | 7/1974 | Brentham | 272/130 |
| 3,825,260 | 7/1974 | Thomas, Sr. | 273/55 R |
| 3,912,265 | 10/1975 | Muir | 272/130 |
| 4,149,715 | 4/1979 | Kusmer | 272/141 |

*Primary Examiner*—Richard C. Pinkham
*Assistant Examiner*—T. Brown
*Attorney, Agent, or Firm*—Leydig, Voit, Osann, Mayer & Holt, Ltd.

[57] ABSTRACT

A blocking sled designed for the development and practice of football pass blocking techniques having a base with an elongated arm pivoted thereto. Operatively connected between the arm and the base is a piston arrangement in which the piston rod supports a compressible spring so that movement of the arm towards a 90° angle with respect to the base is resisted. In use, a player generally stands on either side of the arm and strikes with the palms of his hands an impacting surface integral with the arm, thus causing the arm to move about its pivot through a 90° angle with respect to the base.

7 Claims, 4 Drawing Figures

PASS-BLOCKING SLED

My invention relates to a football blocking sled and more particularly to a blocking sled designed to develop and improve pass blocking techniques.

With the increased popularity of football as both a participant and spectator sport has come the desire to provide aids for the teaching and learning of certain fundamental playing skills. Among the most important of such skills is the ability to block. Aids for developing run blocking techniques have long been available and most familiarly include a blocking sled which includes a padded upright portion supported on runners. In practicing run blocking with the aid of such a device, the player contacts the upright pad with his chest or shoulder and drives the sled across the ground with his legs.

With the increasing emphasis on passing in all levels of organized football there has been a growing desire to provide aids for improving pass blocking technique. Pass blocking differs fundamentally from run blocking in that, while run blocking involves the continuous forward driving of the players legs, pass blocking requires the player to be substantially stationary while fending off an oncoming opponent by hitting such opponent with the palms of his hands. Thus, it is apparent that presently available run blocking sleds are inadequate for developing pass blocking technique.

Good pass blocking technique requires the player to strike the opposing player with the palms of his hands in a partly upward direction, as opposed to only outward. Existing aids for developing pass blocking have primarily consisted of a large dummy either hanging from a chain or mounted on a track along which the dummy will move upon impact. While these types of devices have been an improvement over the use of run blocking sleds, they have proven deficient in that they do not accurately model the forces of a defensive player. Additionally, primarily due to their supporting structure, such blocking dummies have not been long lived.

Thus, it is the primary object of the present invention to provide a blocking sled which more realistically simulates the pass blocking techniques required against an opposing player. A related object is to provide such a pass blocking sled which can be beneficially used by players of differing sizes and strengths. A further object is to provide pass blocking sled which is durable and can be constructed of readily-available materials.

Other objects and advantages of the invention will become apparent upon reading the following detailed description and upon reference to the drawings, in which.

While the invention will be described in connection with its preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
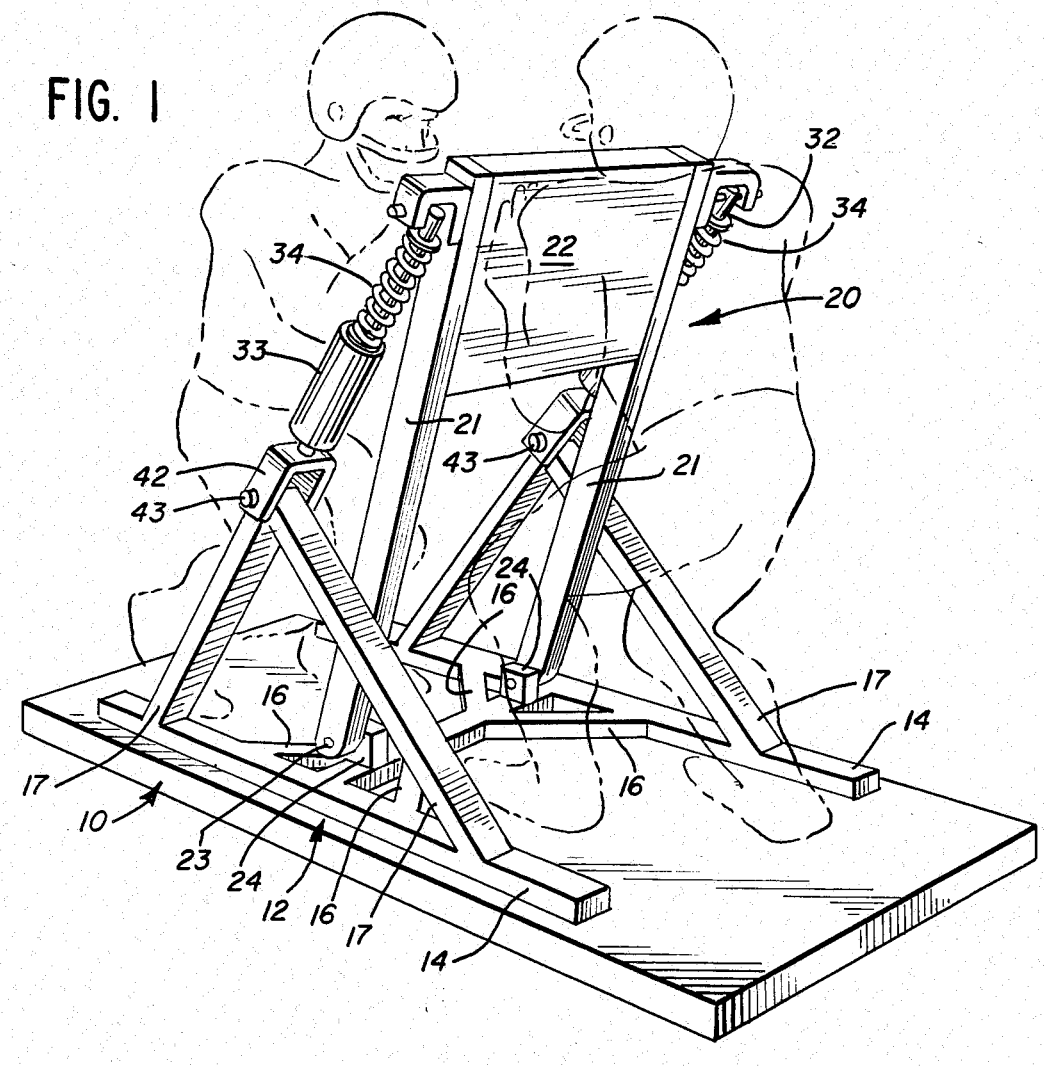
FIG. 1 is a perspective view of a pass blocking sled incorporating the present invention.

Turning first to FIG. 1, there is shown a perspective view of a pass blocking sled 10 of the instant invention having, generally, frame means or base member 12 with elongated arm means 20 pivotally mounted thereto. Connected to the arm means is means for resisting the motion of the arm as it approaches a 90° angle with respect to the base member.

Figure 2:
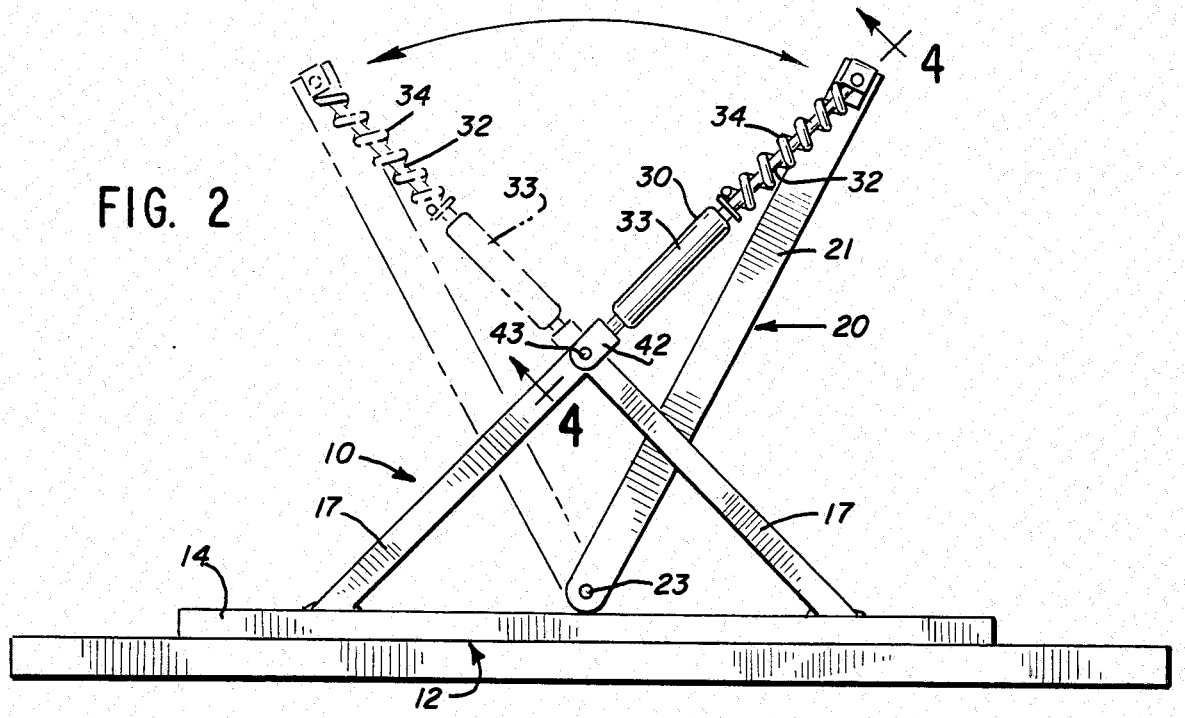
FIG. 2 is a side view of the blocking sled of FIG. 1.

As best seen in FIGS. 1 and 2, the preferred embodiment employs a generally H-shaped base 12 in which the two legs 14 of the base are made from steel channel and are on the order of eight feet in length. The cross bar 15 is made of similar material and is on the order of four feet in length. Bracing or reinforcement 16 can be added in the area of the joints between the legs and the cross bar. The base is further provided with a pair of vertically extending supports 17. As shown, these supports comprise an inverted V and they are preferably made of the same material as the H-shaped portion of the base.

Figure 3:
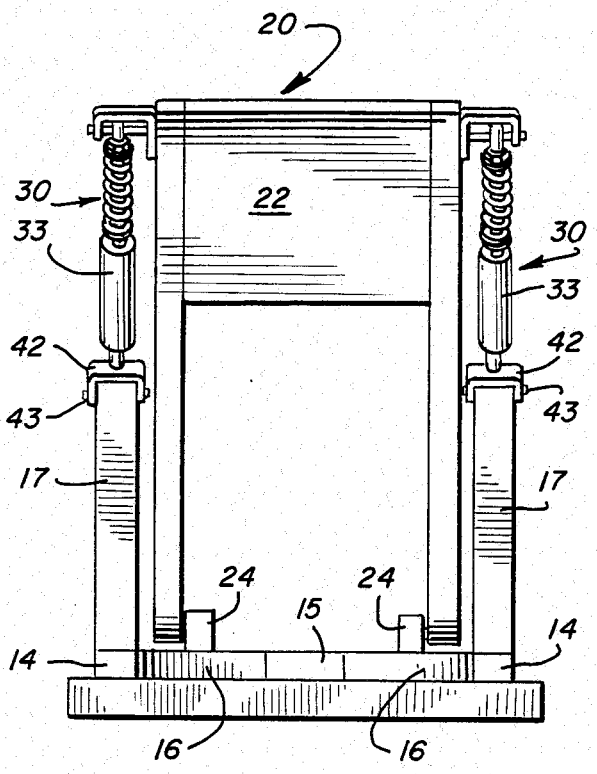
FIG. 3 is an end view of the blocking sled of FIG. 1.

As best seen in FIGS. 1–3, pivoted to the base member 12 is elongated arm means 20. Such arm means is preferably constructed of two elongated members 21 which are made of steel channel and are on the order of five to six feet in length. The arm means 20 is provided with an impacting surface 22 sized to fit within the channels of the elongated members 21. The impacting surface is preferably made of ten gauge sheet steel and is provided with some type of protective covering such as rubber or vinyl so as to protect the player using the device from injury and the surface of 22 from the environment. The impacting surface 22 can be attached to the elongated members 21 by any of a number of well-known methods, including welding.

The arm means 20 is pivoted to the base 12 through axles 23 supported in bearing blocks 24 which are integral with the base. Each pivot axle is constrained within its support by a typical arrangement of bearings.

Figure 4:
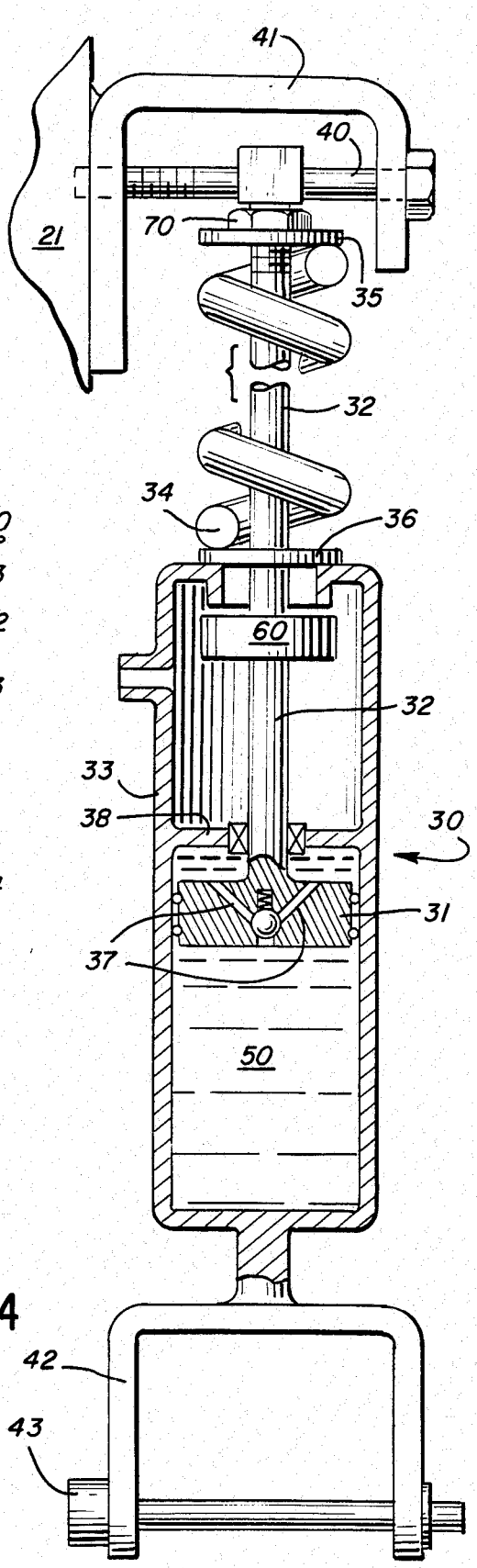
FIG. 4 is an enlarged cross-sectional view taken along line 4—4 in FIG. 2.

Interposed between the base member and the elongated arm means are telescoping resisting means 30. As best seen in FIG. 4, each resisting means generally comprises a piston 31 having a rod 32 and disposed within a cylinder 33. The piston rod is pivotally connected to the elongated arm 20 by means of a pin 40 and bracket 41 welded to the elongated member 21. The cylinder 33 is provided with a yoke 42 at its lower end and is pivotally connected by a pin 43 to a pillow block bearing 44 integral with the vertical support 17.

Disposed on the piston rod 32 between the bracket 41 and the upper end of the cylinder 33 is a helical spring 34 supported on two washers 35, 36. Washer 35 is secured to the piston rod 32 adjacent pivot pin 40, while washer 36 rests against the top of cylinder 33 and is slidable on the piston rod 36. Referring to FIGS. 2 and 4, as the arm means 20 are pivoted about 23 towards vertical, i.e., a 90 degree angle with respect to the base, the piston rod 31 advances into cylinder 33 toward yoke 42, with the portion of the piston rod outside of the cylinder decreasing as the arm means approaches vertical. Washer 36, which engages the upper end of cylinder 33, slides up the piston rod 32 to compress helical spring 34 between the washers 35, 36 thus providing resistance against movement of the arm 22 towards vertical. While the telescoping resisting means 30 has been shown as being pivoted on the base 12 directly above the pivots 23 for the arm means 20, each resisting means may be pivoted to the base at any point not colinear with the arm pivots 23.

In order to prevent the arm 22 from accelerating as it passes through vertical to the opposite side, the resisting means 30 is provided with damping means or a dash pot.

Such damping means may be provided by sealing piston 31 inside the cylinder 38 by means of a wall 38 and filling the resulting chamber with a fluid 50. The piston 31 is further provided with passages 38 through which the fluid 50 must pass in order for the piston to move through the cylinder 33.

Stop means may also be provided to limit the range of motion of the elongated arm 20 with respect to the base 12, preferably to about 30 degrees from either side of vertical. As seen in FIG. 4, piston rod 36 may be provided with a disk 60 secured thereto on the interior of cylinder 38 so that the disk will abut the upper end of the cylinder when the arm 20 has been rotated the desired angle from vertical, thus preventing further movement of the piston rod 36 out of the cylinder. Stop means could alternatively be provided on vertical supports 17 which would abut elongated members 21 to limit the motion of arm 22, or by the bottoming-out of the piston 31 against the wall 38 of the cylinder.

A further feature of the invention is to provide means for adjusting the amount of resistance provided by the spring so that players of differing sizes and strengths may advantageously use the blocking sled. Thus, washer 35 rests against a nut 70 which is threadably received on the upper end of the cylinder rod 32. The nut can be screwed down to preadjust the relaxed length of the spring. In such a manner, the force which the spring exerts can be adjusted.

In operation, a player will generally stand on either side of the arm means 20 between the legs 14 of the base member. The player will assume the "eagle position" in which both feet are firmly planted on the ground and the knees are bent. While holding his elbows in, the player will hit the impacting surface 22 with the palms of his hands while simultaneously extending the rest of his body. The arm means 20 will rotate to the other side of center if the player inputs a sufficient amount of energy. As the arm means 20 passes through the 90 degree angle with respect to the base 12, the dash pot will start to damp out the energy imparted to the arm by the player as well as by the spring. The stop 60 will arrest the motion of the arm once it reaches the desired location on the opposite side of center. Once the arm is in a rest position (as seen in FIG. 2) the process may be repeated.

I claim as my invention:

1. A football pass block training sled comprising, in combination, stationary frame means, pivotally mounted arm means carried by said frame means for rotating motion in the vertical direction, means on said arm means positioned for engagement with the body of a player while practicing pass blocking said arm means being constrained for rotation about 30 degrees from either side of a 90 degree overcenter position, and resilient means for resisting movement by a person of said arm means from a static position on the first side of the overcenter position toward the 90 degree overcenter position and controllably thereafter moving the arm to a static position on the second side of the overcenter position and for also resisting movement by a person of said arm means from a static position on the second side of the overcenter position toward the 90 degree overcenter position and controllably thereafter moving the arm to a static position on the first side of the overcenter position.

2. A football pass block training sled comprising, in combination, a stationary base member, an elongated arm means pivotally mounted to said base member, means on said arm means positioned for engagement with the body of a player while practicing pass blocking and resisting means connected to said arm means, said resisting means further comprising a telescoping member having first and second ends pivotally mounted to said base member and to said arm means respectively with compressible spring means disposed between said first and second ends, said spring means sized so as said arm means approaches a 90° angle with respect to said base, said spring means is compressed, thus resisting the movement of said arm means towards said 90° angle, so that one person may stand on either side of said arm means and apply continuing force thereto sufficient to rotate said arm means to at least the 90° angle position.

3. The blocking sled of claim 2 further comprising means for damping the force of said resisting means.

4. The pass block sled of claim 3 wherein said damping means comprises a dashpot integral with said resisting means.

5. The pass block sled of claim 2 further comprising means for adjusting the amount of resistance offered by said resisting means.

6. The blocking sled of claim 5 wherein said resistance adjusting means includes means for adjustably pre-stressing said spring means.

7. The pass block sled of claim 6 further comprising stop means for limiting the range of motion of said arm means with respect to said base.

* * * * *